US008496439B2

(12) United States Patent
Rajagopalan

(10) Patent No.: US 8,496,439 B2
(45) Date of Patent: Jul. 30, 2013

(54) TURBOMACHINE BLADE LOCKING STRUCTURE INCLUDING SHAPE MEMORY ALLOY

(75) Inventor: Sudhir Rajagopalan, Chuluota, FL (US)

(73) Assignee: Siemens Energy, Inc., Orlando, FL (US)

( * ) Notice: Subject to any disclaimer, the term of this patent is extended or adjusted under 35 U.S.C. 154(b) by 805 days.

(21) Appl. No.: 12/725,504

(22) Filed: Mar. 17, 2010

(65) Prior Publication Data

US 2011/0229328 A1 Sep. 22, 2011

(51) Int. Cl.
*F01D 5/32* (2006.01)

(52) U.S. Cl.
USPC ..... 416/220 R

(58) Field of Classification Search
USPC ..... 416/220 R, 221, 219 R
See application file for complete search history.

(56) References Cited

U.S. PATENT DOCUMENTS

| | | | |
|---|---|---|---|
| 2,753,149 | A | 7/1956 | Kurti |
| 2,843,356 | A | 7/1958 | Hull, Jr. |
| 2,867,408 | A | 1/1959 | Kolb et al. |
| 3,001,760 | A | 9/1961 | Guernsey et al. |
| 3,202,398 | A | 8/1965 | Webb |
| 3,759,633 | A | 9/1973 | Tournere |
| 4,466,776 | A | 8/1984 | Camboulives |
| 4,676,723 | A | 6/1987 | Kiger et al. |
| 4,915,587 | A | 4/1990 | Pisz et al. |

FOREIGN PATENT DOCUMENTS

JP 01069702 A * 3/1989

* cited by examiner

*Primary Examiner* — Dwayne J White

(57) ABSTRACT

A system for locking blades to a rotor of a turbomachine including adjacent pairs of generally axially extending grooves for receiving blades inserted in an axial direction. A circumferential slot is disposed around the periphery of the rotor and a locking device assembly is located in the circumferential slot between an adjacent pair of grooves. The assembly includes a last locking device, a spacer and key member formed of a shape memory alloy. The key member is located in a gap between the last locking device and the spacer. The shape memory alloy key member is heated to cause a transition from a martensite to an austenite phase to cause the key member to engage and press against opposing faces of the last locking device and the spacer to increase a force applied to a respective pair of blades in the adjacent pair of grooves.

17 Claims, 4 Drawing Sheets

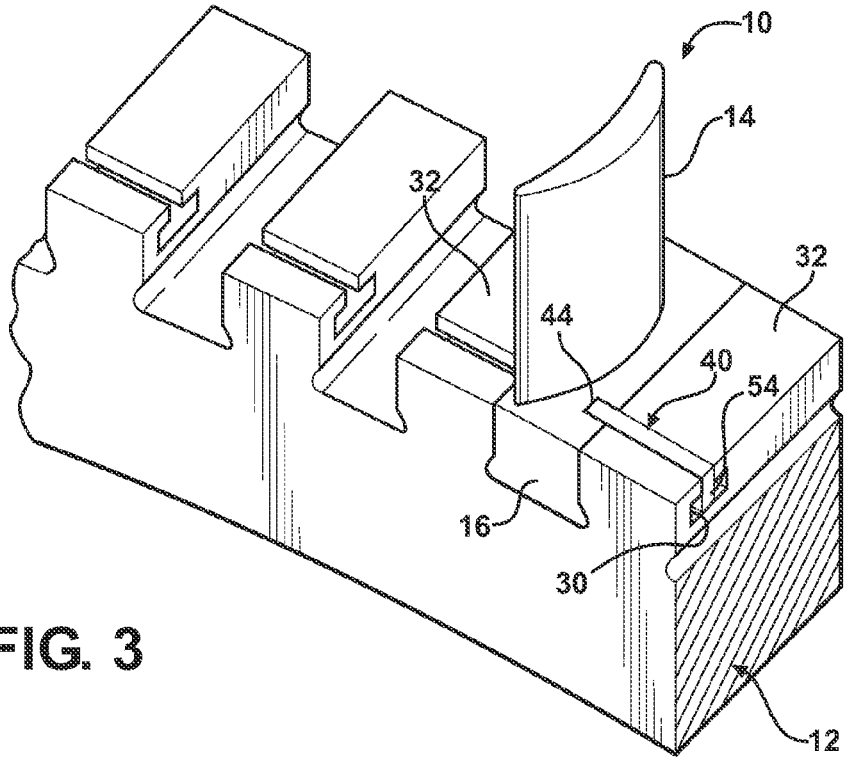
FIG. 3
FIG. 4
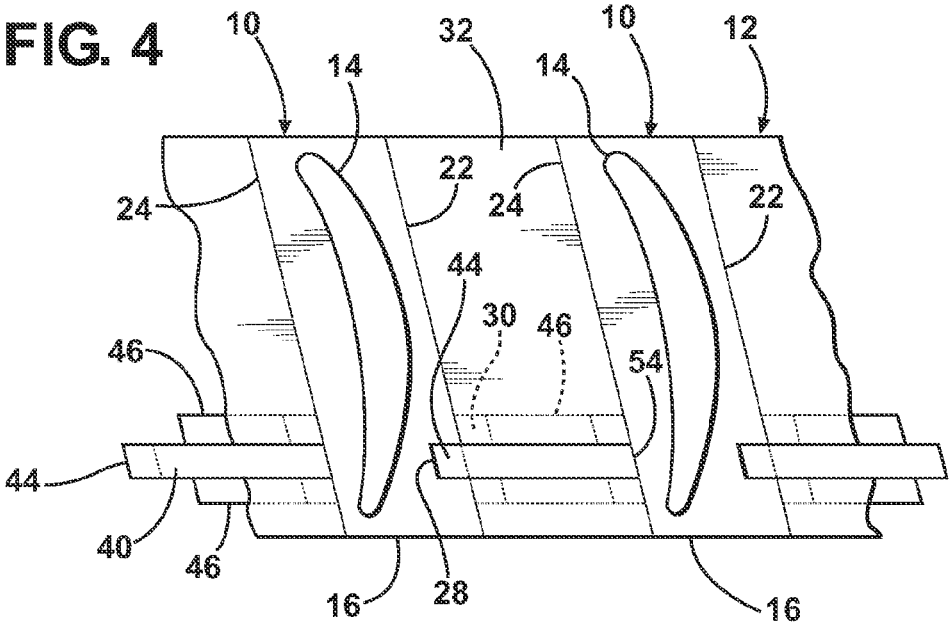

FIG. 8
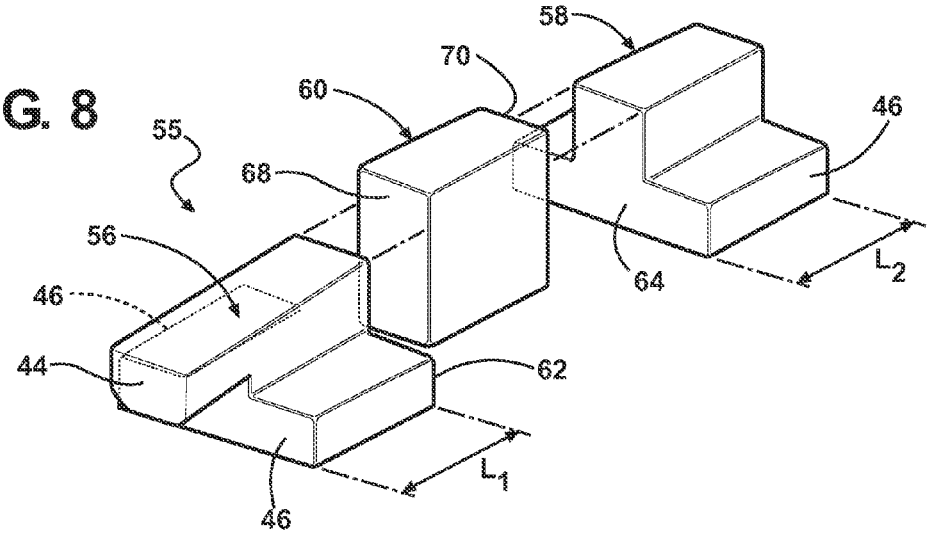
FIG. 9
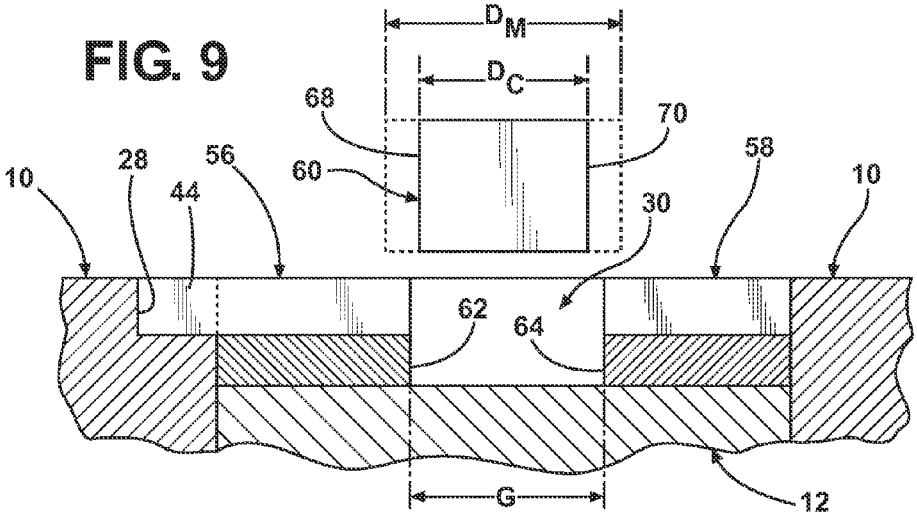
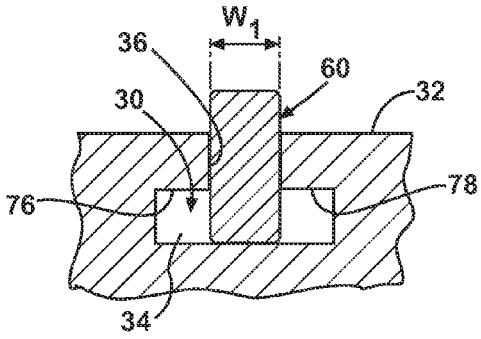
FIG. 10
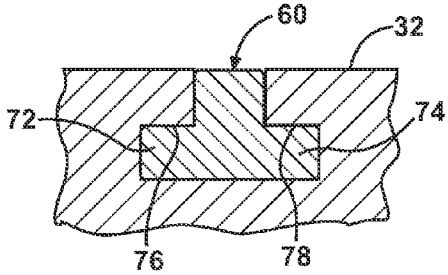
FIG. 11

TURBOMACHINE BLADE LOCKING STRUCTURE INCLUDING SHAPE MEMORY ALLOY

FIELD OF THE INVENTION

The present invention relates to rotors for turbomachinary and, more particularly, to devices for locking side entry blades into rotors, such as in turbine engines.

BACKGROUND OF THE INVENTION

Compressors, fans, turbines and like machinery employ rotors to which a plurality of blades are affixed. Such blades are arranged into one or more rows spaced axially along the rotor, the blades in each row being circumferentially arrayed around the periphery of the rotor.

As a result of the high steady and vibratory forces imposed on the blades during operation, the method of attaching the blades to the rotor requires careful design. One method of attachment employs generally axially extending grooves formed in the rotor periphery. The shape of the grooves may be that of a fir-tree, serrated, semi-circle, inverted T, or some variation thereof. Each blade has a corresponding root portion at its base which is closely profiled to match the shape of the rotor grooves. Each blade is retained in the rotor by sliding the root of the blade axially into a rotor groove. Blades affixed to the rotor in this manner are referred to as side entry blades. As a result of the close match in the size and shape of the blade root and the rotor groove, motion of the blade in the circumferential and radial directions is closely restrained. However, restraint of the blade in the axial direction, referred to as locking, requires a separate device. In the past, a variety of locking devices have been devised.

One such locking device comprises a locking device which is engaged in a circumferential slot between adjacent blades supported in axial grooves of a rotor. In an embodiment of the locking device, the locking device is formed with a key for engaging a slot in one of the blades and has a length shorter than the distance between the adjacent blades. A lug is formed on a side of the locking device opposite from the key, and a spacer is located in the circumferential slot and includes a lug adjacent to the lug on the locking device. The lugs on the locking device and the spacer are bent to engage each other and bias the locking device and spacer toward respective blades. Removal of the blades requires bending the lugs to a disengaged position, typically requiring that the locking device and spacer be scrapped and replaced by new components during blade replacement. Such a device is disclosed in U.S. Pat. No. 4,915,587, the entire disclosure of which is incorporated herein.

SUMMARY OF THE INVENTION

In accordance with one aspect of the invention, a system is provided for locking blades of a turbomachine to a rotor. The system comprises an adjacent pair of generally axially extending grooves, spaced about a periphery of the rotor, each groove receiving a blade inserted in an axial direction. A circumferential slot is disposed around the periphery of the rotor extending between the adjacent pair of grooves in an intermediate portion of the rotor. A locking device is provided for locating in the circumferential slot between the adjacent pair of grooves. A spacer is provided for locating in the circumferential slot adjacent to the locking device between the adjacent pair of grooves. A gap is defined between opposing faces of the locking device and the spacer. A thermally activated key member is provided for locating in the gap, wherein an increase in temperature of the key member from a first temperature state to a second temperature state causes the key member to frictionally engage and press against the opposing faces to cause the locking device and the spacer to increase a force applied to a respective pair of blades in the adjacent pair of grooves.

In accordance with another aspect of the invention, a system is provided for locking blades of a turbine engine to a rotor. The system comprises a plurality of generally axially extending grooves, spaced about a periphery of the rotor in a row, each groove receiving a blade inserted in an axial direction. A circumferential slot is disposed around the periphery of the rotor, portions of the circumferential slot being disposed in intermediate portions of the rotor between each adjacent pair of the grooves. A plurality of locking devices are provided for locating in the circumferential slot between the adjacent pairs of grooves. One of the locking devices comprises a last locking device for locking a last one of the blades installed in the row. The last locking device has a lengthwise dimension for extending in the direction of the circumferential slot less than a distance between the adjacent pairs of grooves. A spacer is provided for locating in the circumferential slot adjacent to the last locking device, the spacer having a lengthwise dimension for extending in the direction of the circumferential slot less than the distance between the adjacent pairs of grooves. The combined lengthwise dimension of the last locking device and the spacer is less than the distance between the adjacent pairs of grooves. A key member is provided formed of a shape memory alloy for locating in a gap between opposing faces of the last locking device and the spacer. The key member has a first lengthwise dimension that is less than the gap at a first state of the key member at a first temperature, and the key member has a second lengthwise dimension that is at least as great as the gap at a second state of the key member at a second temperature. The second state of the key member causes the key member to frictionally engage and press against the opposing faces of the last locking device and the spacer to increase a force applied to a respective pair of blades in an adjacent pair of grooves.

The locking device may include a locking portion for extending beyond the intermediate portion into an adjacent groove for engaging a blade located in the adjacent groove.

The shape memory alloy may comprise an alloy exhibiting a martensite phase in the first temperature state when cooled to a temperature equal to or less than a martensite finish temperature, and an austenite phase in the second temperature state when heated to an austenite finish temperature less than ambient temperature.

An axial width of the circumferential slot in the disk may be greater at a radially inner slot portion than at a radially outer slot portion, and an axial width of the locking devices may be greater at a radially inner base portion of the locking devices than at a radially outer locking device portion, whereby the locking devices mate with the circumferential slot thereby restraining the motion of the locking devices in the radial direction.

The circumferential slot, the locking devices and the spacer may each have a cross-section shaped as an inverted T comprising a center portion forming the vertical portion of the T, and axially extending portions extending from the center portion forming the horizontal portion of the T.

In the first state of the key member, the key member may have a generally rectangular shape defining a width less than the width of the circumferential slot at the radially outer slot portion, and in the second state of the key member, the key member may distribute widthwise into the radially inner slot portion to comprise a radially inner key portion having a width that is substantially greater than the width of the circumferential slot at the radially outer slot portion, thereby restraining the motion of the key member in the radial direction.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 3 is a perspective view of a compressor blade installed in the rotor disk with a locking device;

FIG. 4 is a plan view of a portion of the periphery of the rotor disk showing a pair of blades locked to the disk;

FIG. 8 is a perspective view of the components forming the last blade locking assembly;

FIG. 9 is a cross-sectional view in an axial direction through an intermediate portion of the disk showing a last blade locking device and spacer in the circumferential slot, and forming a gap for receiving a shape memory alloy key member;

FIG. 10 is a cross-sectional view in a circumferential direction through the circumferential slot and showing the key member in a martensite phase of the shape memory alloy after insertion in the gap between the last blade locking device and the spacer; and FIG. 11 is a cross-sectional view in the circumferential direction through the circumferential slot and showing the key member in an austenite phase of the shape memory alloy, defining a locking configuration of the key member in the gap between the last blade locking device and the spacer.

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
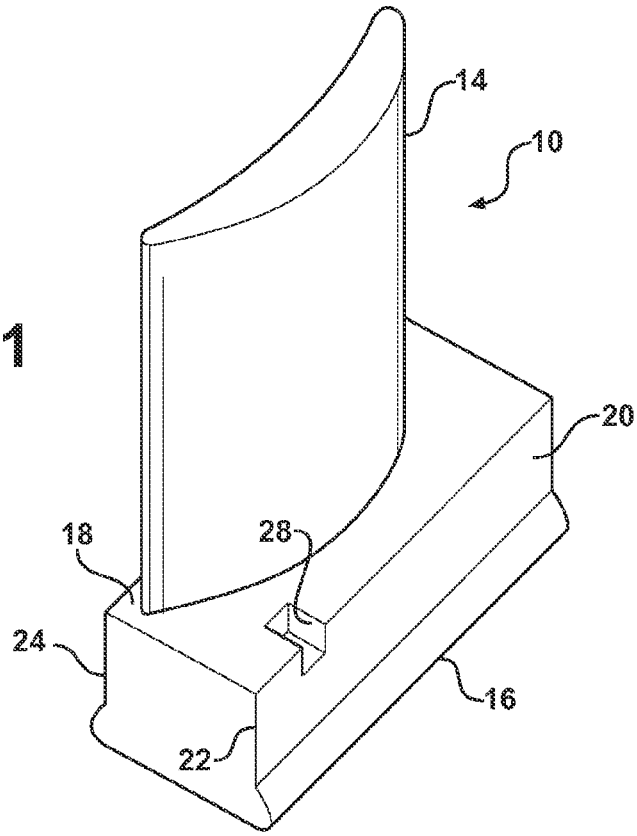
FIG. 1 is a perspective view of a compressor blade for use with the present invention.
Figure 2:
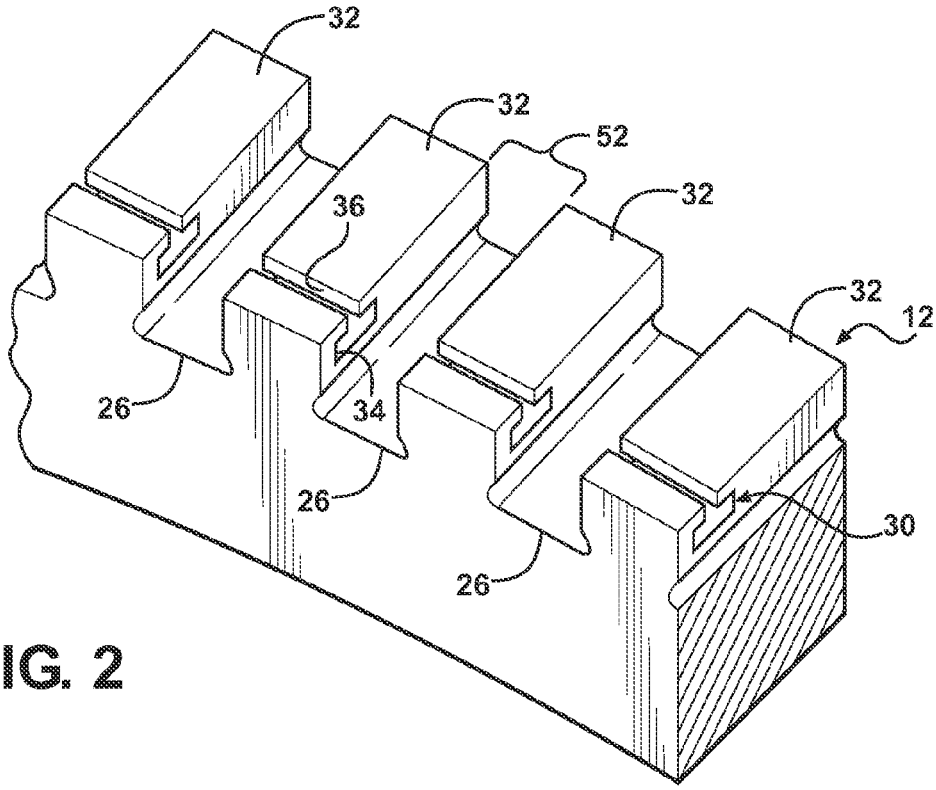
FIG. 2 is a perspective view of a portion of the periphery of a rotor disk, showing axial grooves for receiving blades and a circumferential slot for receiving a locking device in accordance with the present invention.

As shown in FIGS. 1 and 2, a blade 10 representative of a plurality of blades is provided for mounting in a rotor disk 12 for a turbine engine, such as may be provided, for example, in a compressor assembly of an axial flow gas turbine engine. The blade 10 is comprised of an airfoil 14 and a root 16, the airfoil 14 extends directly from the root 16, hence the blade 10 may be formed without a platform at the base of the airfoil 14. However, it should be understood that the present invention is not limited by the particular blade described herein, and a blade for use in the present invention may comprise a platform to the extent that the locking structure described below may also be incorporated in the disk 12. Further, an upper portion 18 of the blade root 16 may define a platform along an upper surface portion thereof for directing flow of gases between the airfoils 14 and across an outer periphery of the disk 12.

The upper portion 18 of the blade root 16 forms a shank 20 having two generally axially extending sides 22 and 24. The size and the shape of the blade roots 16 closely match those of axially extending grooves 26 arranged in a row and spaced about the periphery of the disk 12, shown in FIG. 2. It should be understood that the present invention is not limited to the particular attachment configuration illustrated for the blade root 16 and groove 26 illustrated herein, and other shapes may be implemented including, for example, that of a fir-tree, serrated, semi-circle, inverted T, or some variation thereof. Each blade 10 is retained in the disk 12 by sliding the root 16 of the blade 10 into its respective groove 26, as shown in FIG. 3.

Locking is enabled by means of a recess 28 that may be machined or otherwise formed in the side 22 of each blade root shank 20, as shown in FIG. 1, and by means of a circumferential slot 30 around the periphery of the rotor disk 12, as shown in FIG. 2, such that a portion of the circumferential slot 30 is formed between each adjacent pair of grooves 26. In particular, the circumferential slot 30 is defined in intermediate portions 32 of the disk 12 between each adjacent pair of grooves 26. The slot 30 may have a cross-section shaped as an inverted T, or any other suitable shape so long as the width of the slot 30 at its base 34, i.e., at a radially inner portion of the slot 30, is wider than the width at its periphery 36, i.e., at a radially outer portion of the slot 30, to facilitate retention of locking devices.

Figure 5:
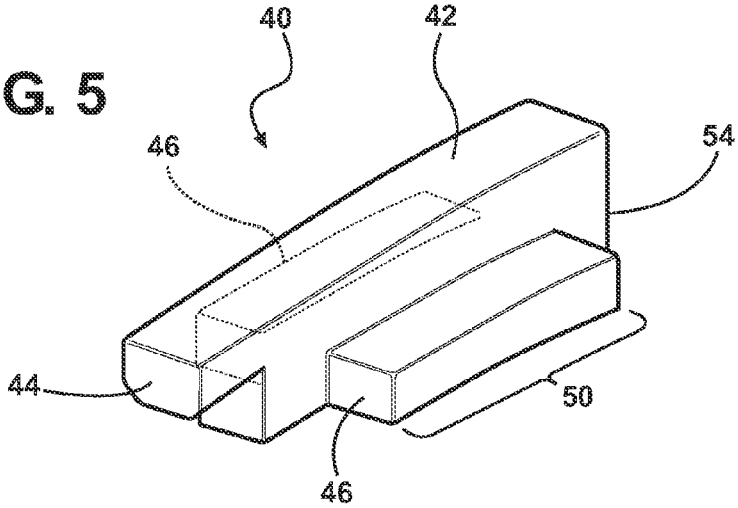
FIG. 5 is a perspective view of a locking device for locking all but the last blade.
Figure 6:
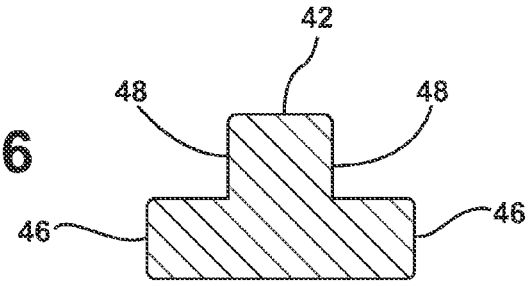
FIG. 6 is a vertical cross-section through the locking device shown in FIG. 5.

Referring to FIG. 5, a locking device 40 is provided for each blade root 16 wherein the locking device 40 may comprise an arcuate member. A radius of curvature of an outer surface of a center portion 42 of the locking device 40 matches that of the disk periphery so that when installed, as shown in FIG. 4, an aerodynamically smooth surface is obtained. A locking portion or detent 44 is formed at one end of the locking device 40 which is insertable into the recess 28 in the blade root 16. Rails 46 extend laterally from either side 48 of the center portion 42, as seen in FIG. 6. The shape of the cross-section of the locking device 40 is similar to that of the circumferential slot 30, such as a T-shape. The rails 46 mate with the corresponding base 34 of the slot 30 to support the centrifugal load on the device and restrain motion in the radial direction.

The blades 10 are installed and locked in the rotor disk 12 sequentially. A blade root 16 is inserted axially into a groove 26 and a locking device 40 is inserted into the empty groove 30 in the intermediate portion 32 adjacent to the side 22 of the blade root shank 20 which contains the recess 28. A length 50 of the support rails 46, as shown in FIG. 5, is less than a width 52 of the upper portion of the grooves 38, shown in FIG. 2. Hence, the locking device 40 can be inserted into the groove 26 and slid circumferentially into the slot 30 so that its detent 44 engages the recess 28 in the blade root 16, as shown in FIGS. 3 and 4. Subsequently, the next blade 10 is installed in the portion of the groove 30 defined in an adjacent intermediate portion 32 and the procedure is repeated until all but the last blade is installed. Each locking device 40 spans from the recess 28 of the locked blade 10 to the blade root 16, i.e., the shank 20, of an adjacent blade 10 so that, as shown in FIG. 4, an end 54 of the locking device 40 abuts side 24 of the adjacent blade shank 20. Thus disengagement of the detents 44 in the recesses 28 is prevented by restraining the motion of the locking devices 40 in the circumferential direction.

Figure 7:
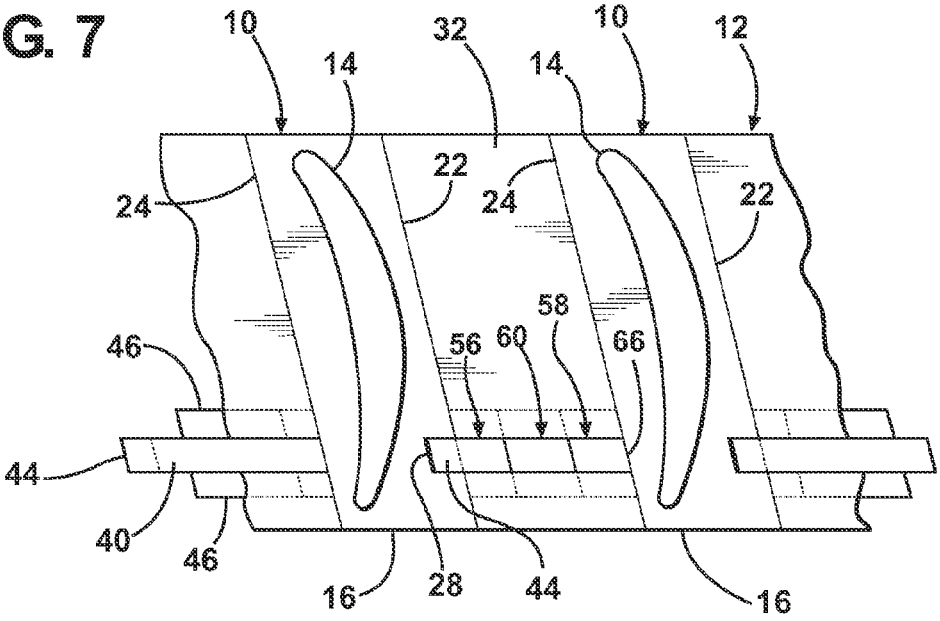
FIG. 7 is a plan view of a portion of the periphery of the rotor disk showing a last blade locked in place with a last blade locking assembly in accordance with the present invention.

In accordance with the invention, a last blade locking assembly 55 comprising a last locking device 56, a spacer 58 and a key member 60, shown in FIGS. 7 and 8, is used to lock the last blade 10 that is installed into the row of grooves 26 in the disk 12. The last locking device 56 is similar to the standard locking device 40, generally comprising a T-shaped member, except that it is shorter, comprising a lengthwise dimension $L_1$ extending in the direction of the circumferential slot 30 that is less than a distance between the adjacent pairs of grooves 26 on either side of the intermediate portion 32. The spacer 58 is also similar to the locking device 40, except that the spacer does not include a detent 44. The spacer 58 generally comprises a T-shaped member, and has a lengthwise dimension $L_2$ extending in the direction of the circumferential slot 30 that is less than a distance between the adjacent pairs of grooves 26. The combined lengthwise dimension of the last locking device 56 and the spacer 58 is less than the distance between the adjacent pairs of grooves 26, whereby a gap G is defined between opposing faces 62, 64 of the last locking device 56 and the spacer 58 when installed in the circumferential slot 30.

The key member 60 is formed of a thermally activated material, preferably comprising a shape memory alloy, for locating in the gap G between the opposing faces 62, 64 of the last locking device 56 and the spacer 58. In the illustrated embodiment, the shape memory alloy comprises an alloy exhibiting a martensite phase when cooled to a temperature equal to or less than a martensite finish temperature $M_f$ and exhibiting an austenite phase when heated to a temperature equal to or greater than an austenite finish temperature $A_f$. The shape memory alloy begins its transformation from austenite to martensite at a martensite start temperature $M_s$, which temperature is greater than the martensite finish temperature $M_f$. Further, the shape memory alloy begins its transformation from martensite to austenite at the austenite start temperature $A_s$, which temperature is less than the austenite finish temperature $A_f$. The shape memory alloy is less stiff in the martensite phase than in the austenite phase. Preferably, the austenite finish temperature $A_f$ is less than a predefined temperature. Since the martensite start and finish temperatures $M_s$ and $M_f$ are less than the austenite start and finish temperatures $A_s$ and $A_f$, the martensite start and finish temperatures $M_s$ and $M_f$ are also less than the predefined temperature. In the illustrated embodiment, the predefined temperature comprises ambient temperature, such as a temperature falling within a range of between about −40 and about 80 degrees F. In any event, it is also preferred that the austenite finish temperature $A_f$ be less than about 150 degrees F.

The key member 60 is manufactured while in the austenite phase to have a manufactured shape comprising a predetermined initial manufactured length dimension $D_M$ (FIG. 9) and a predetermined cross-sectional shape, such as is illustrated in FIG. 11. The key member 60 may be reshaped to have a shorter length $D_C$, and a rectangular cross-section having a width dimension $W_1$ (FIG. 10), while in the cooler martensite phase, for locating in the gap G between the last locking device 56 and the spacer 58 during an operation of locking the last blade 10 in place. In particular, in accordance with a first possible reshaping procedure, the key member 60 may be conditioned or trained to the rectangular cross-section configuration in the martensite phase, such as may be accomplished through a repetitive shaping process known in the art for conditioning or training shape memory alloys. In accordance with an alternative reshaping procedure, the key member 60 may be compressed, or otherwise reformed by application of reshaping forces, while in the less stiff or more pliable martensite phase to conform to the generally rectangular shape illustrated in FIGS. 8-10. It should be understood that, without departing from the spirit and scope of the present invention, the reshaped configuration of the key member 60 may comprise other shapes than that illustrated herein.

Example shape memory alloys which are believed to be capable of being used in forming the key member 60 include, but are not intended to be limited to, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-palladium based alloys, ruthenium-niobium based alloys, ruthenium-tantalum based alloys, titanium based alloys, and the like.

During a process of installing the last blade locking assembly 55 on the disk 12, after installation of the next to last blade 10, the last locking device 56 and the spacer 58 are installed into the circumferential groove 30 on the intermediate portion 32 between the first blade groove 26 and the last blade groove 26. The last blade 10 is insert axially into the last blade groove 26, the last locking device 56 is positioned with its detent 44 in the recess 28 of the last blade 10, and the spacer 58 is positioned with an end surface 66 thereof engaged on the side 24 of the first blade shank 20 to define the gap G between the opposing faces 62, 64 of the last locking device 56 and the spacer 58. For the purposes of this operation, it should be noted that the gap G must be at least as great as the distance that the detent 44 extends into the recess 28 in order to allow the last locking device 56 to be positioned circumferentially away from the last blade groove 26 for the last blade 10 to be inserted while clearing the detent 44.

The key member 60 is then inserted into the gap G comprising initially cooling the key member 60 to a first temperature state corresponding to the martensite phase of the shape memory alloy, i.e., cooled to at least the martensite finish temperature $M_f$, such that the key member 60 either returns to its trained shape or may be reshaped by application of reshaping forces to form the key member 60 into the predetermined shape for insertion, i.e., a rectangular shape. The reshaped key member 60 has the shorter length dimension $D_C$ comprising a first lengthwise dimension that is less than the initial manufactured dimension $D_M$ and less than the dimension of the gap G in the circumferential direction, see FIG. 9. For example, the shorter lengthwise dimension $D_C$ of the key member 60 in the martensite phase may be from about 5% to about 8% less than the initial manufactured lengthwise dimension $D_M$ of the key member 60. The key member 60 is located in the gap G, between the opposing faces 62, 64, and is then heated to a second temperature state corresponding to the austenite phase of the shape memory alloy, i.e., heated to at least the austenite finish temperature $A_f$, causing the shape memory alloy to return toward its original shape, such that the length of the key member 60 is at least as great as the dimension of the gap G and will generally be equal to the gap G. As the shape memory alloy returns toward its original shape, opposing ends 68, 70 of the key member 60 (FIG. 9) frictionally engage and press circumferentially outwardly on the respective opposing faces 62, 64, to bias the last locking device 56 and spacer 58 toward and increase a force against the respective last and first blades 10 in the adjacent grooves 26 and to provide a force to lock the last blade 10 in place. It should be noted that the final length of the key member 60 positioned in the gap in the austenite phase of the shape memory alloy is less than the manufactured length dimension $D_M$, such that the force applied by the key member 60 may be controlled by selection of a particular manufactured length dimension $D_M$ that the key member 60 will tend to return toward within the gap G when heated and transitioned from the martensite phase to the austenite phase.

Referring to FIG. 10, the width dimension $W_1$ of the key member 60 in the martensite phase of the shape memory alloy is preferably less than the widthwise dimension of the radially outer periphery 36 of the circumferential slot 30, when inserted through the slot 30. When the key member 60 is heated and transitioned to the austenite phase, the radially inner portion of the key member 60 moves out into the horizontal base portion 34 of the T-shaped slot 30, as seen in FIG. 11. In particular, as the material of key member 60 returns to its original or manufactured shape, it moves or distributes laterally outwardly to form lateral portions 72, 74 defining a radially inner key portion engaged with overhang portions 76, 78 of the slot base 34. The lateral portions 72, 74 cooperate with the overhang portions 76, 78 to prevent disengagement of the key member 60 in the radial direction during rotation of the disk 12.

The radial height of the key member 60 is such that it preferably extends outwardly of the slot 30 past the radially outer periphery 36 of the slot 30 when it is inserted into the slot 30 in the martensite phase. During distribution of the shape memory alloy of the key member 60 laterally into the base 34, the height of the key member 60 will decrease. Hence, the reshaped key member 60 is formed with a predetermined height extending out of the slot 30, and the final height dimension of the key member 60, after distribution of the shape memory alloy toward the overhang portions 76, 78 of the base 34, will be substantially flush with the outer surface of the disk 12

It should be noted that the manufactured width of the radially outer portion of the key member 60 in the austenite phase of the shape memory alloy may be greater than the width $W_1$ in the martensite phase of the shape memory alloy prior to locating the key member 60 in the gap G. In particular, both the radially inner and radially outer portions of the key member 60 may be reshaped in the widthwise direction, i.e., reformed to a narrower width, in addition to the reshaping of the key member in the lengthwise direction, to form the key member to the widthwise dimension $W_1$ in the martensite phase of the shape memory alloy.

The process of heating the key member 60 to effect locking of the last blade locking assembly 55 is performed without adding an amount of heat energy required to effect melting of the key member shape memory alloy. Only a very small amount of energy in the form of heat is required to raise the temperature of the key member 60 to the austenite finish temperature $A_f$, which, as noted above, is preferably less than about 150 degrees F. Hence, no substantial alteration of the final internal structure of the key member 60 is believed to occur during the locking operation of engaging the key member 60 to the disk 12 between the last locking device 56 and the spacer 58.

During a disassembly step, such as to remove one or more blades 10 from the disk 12, the key member 60 is preferably cooled below the martensite finish temperature $M_f$ such that the key member 60 may be easily removed from the gap G. Hence, the last locking device 56, spacer 58 and key member 60 may be released from locking engagement without damaging or destroying these components, permitting the last blade locking assembly 55 to be reused in a subsequent assembly locking operation.

It should be noted that although the invention has been described as incorporated in the axial flow compressor of a gas turbine engine, it is applicable to any rotor featuring side entry blades.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A system for locking blades of a turbomachine to a rotor, the system comprising:

an adjacent pair of generally axially extending grooves, spaced about a periphery of the rotor, each said groove for receiving a blade inserted in an axial direction;

a circumferential slot disposed around the periphery of the rotor extending between said adjacent pair of grooves in an intermediate portion of the rotor;

a locking device for locating in said circumferential slot between said adjacent pair of grooves;

a spacer for locating in said circumferential slot adjacent to said locking device between said adjacent pair of grooves;

a gap defined between opposing faces of said locking device and said spacer; and a thermally activated key member for locating in said gap, wherein an increase in temperature of said key member from a first temperature state to a second temperature state causes said key member to frictionally engage and press against said opposing faces to cause said locking device and said spacer to increase a force applied to a respective pair of blades in said adjacent pair of grooves.

2. The system of claim 1, wherein said locking device includes a locking portion for extending beyond said intermediate portion into an adjacent groove for engaging a blade located in said adjacent groove.

3. The system of claim 1, wherein said key member is formed from a shape memory alloy.

4. The system of claim 3, wherein said shape memory alloy comprises an alloy exhibiting a martensite phase in said first temperature state when cooled to a temperature equal to or less than a martensite finish temperature, and an austenite phase in said second temperature state when heated to an austenite finish temperature less than ambient temperature.

5. The system of claim 1, wherein:

an axial width of said circumferential slot is greater at a radially inner slot portion than at a radially outer slot portion; and an axial width of said locking device is greater at a radially inner base portion of said locking device than at a radially outer locking device portion, whereby said locking device mates with said circumferential slot thereby restraining the motion of said locking device in the radial direction.

6. The system of claim 5, wherein said circumferential slot, said locking device and said spacer each have a cross-section shaped as an inverted T comprising a center portion forming the vertical portion of said T, and axially extending portions extending from said center portion forming the horizontal portion of said T.

7. The system of claim 5, wherein:

in said first state of said key member, said key member has a generally rectangular shape defining a width less than said width of said circumferential slot at said radially outer slot portion; and in said second state of said key member, material of said key member distributes widthwise into said radially inner slot portion, and comprises a radially inner key portion having a width that is substantially greater than said width of said circumferential slot at said radially outer slot portion, thereby restraining the motion of said key member in the radial direction.

8. A system for locking blades of a turbine engine to a rotor, the system comprising:

a plurality of generally axially extending grooves, spaced about a periphery of the rotor in a row, each said groove for receiving a blade inserted in an axial direction;

a circumferential slot disposed around the periphery of the rotor, portions of said circumferential slot being disposed in intermediate portions of the rotor between each adjacent pair of said grooves;

a plurality of locking devices for locating in said circumferential slot between said adjacent pairs of grooves;

one of said locking devices comprising a last locking device for locking a last one of said blades installed in said row, said last locking device having a lengthwise dimension for extending in the direction of said circumferential slot less than a distance between said adjacent pairs of grooves;

a spacer for locating in said circumferential slot adjacent to said last locking device, said spacer having a lengthwise dimension for extending in the direction of said circumferential slot less than the distance between said adjacent pairs of grooves, wherein the combined lengthwise dimension of said last locking device and said spacer is less than the distance between said adjacent pairs of grooves; and a key member formed of a shape memory alloy for locating in a gap between opposing faces of said last locking device and said spacer, and said key member having a first lengthwise dimension that is less than said gap at a first state of said key member at a first temperature, and said key member having a second lengthwise dimension that is at least as great as said gap at a second state of said key member at a second temperature, wherein said second state of said key member causes said key member to frictionally engage and press against said opposing faces of said last locking device and said spacer to increase a force applied to a respective pair of blades in an adjacent pair of grooves.

9. The system of claim 8, wherein each said locking device includes a locking portion for extending beyond a respective one of said intermediate portions into an adjacent groove for engaging a blade located in said adjacent groove.

10. The system of claim 8, wherein each of said locking devices, except said last locking device, spans a respective one of said intermediate portions between said adjacent pairs of grooves.

11. The system of claim 8, wherein said shape memory alloy comprises an alloy exhibiting a martensite phase when cooled to a temperature equal to or less than a martensite finish temperature, for assuming said first lengthwise dimension, and an austenite phase when heated to an austenite finish temperature less than ambient temperature, for assuming said second lengthwise dimension.

12. The system of claim 11, wherein said key member has an initial manufactured lengthwise dimension in the austenite phase greater than said first lengthwise dimension, and said key member is reshaped to said first lengthwise dimension from said initial manufactured lengthwise dimension prior to locating said key member in said gap.

13. The system of claim 12, wherein said first lengthwise dimension of said key member is from about 5% to about 8% less than said initial manufactured lengthwise dimension.

14. The system of claim 8, wherein said second dimension is obtained without adding an amount of heat required to effect melting of said key member shape memory alloy.

15. The system of claim 8, wherein:

a width of said circumferential slot is greater at a radially inner slot portion than at a radially outer slot portion; and a width of said locking devices is greater at a radially inner base portion of said locking devices than at a radially outer locking device portion, whereby said locking devices mate with said circumferential slot thereby restraining the motion of said locking devices in the radial direction.

16. The system of claim 15, wherein said circumferential slot, said locking devices and said spacer each have a cross-section shaped as an inverted T comprising a center portion forming the vertical portion of said T, and axially extending portions extending from said center portion forming the horizontal portion of said T.

17. The system of claim 15, wherein:

in said first state of said key member, said key member has a generally rectangular shape defining a width less than said width of said circumferential slot at said radially outer slot portion; and in said second state of said key member, material of said key member distributes widthwise into said radially inner slot portion, and comprises a radially inner key portion having a width that is substantially greater than said width of said circumferential slot at said radially outer slot portion, thereby restraining the motion of said key member in the radial direction.

* * * * *